United States Patent [19]

Moreno

[11] 4,120,595

[45] Oct. 17, 1978

[54] PEN FOR WRITING A DOUBLE LINE

[76] Inventor: Joseph A. Moreno, P.O. Box 568, Saegertown, Pa. 16433

[21] Appl. No.: 749,449

[22] Filed: Dec. 10, 1976

[51] Int. Cl.[2] ..... B43K 27/04; B43K 27/08

[52] U.S. Cl. ..... 401/35

[58] Field of Search ..... 401/35, 34

[56] References Cited

U.S. PATENT DOCUMENTS 2,585,016 2/1952 Kollsman ..... 401/35

FOREIGN PATENT DOCUMENTS 55,140 6/1961 France ..... 401/35

1,349,384 12/1964 France ..... 401/35

475,483 10/1952 Italy ..... 401/35

*Primary Examiner*—Stephen C. Pellegrino

*Attorney, Agent, or Firm*—Charles L. Lovercheck

[57] ABSTRACT

A pen having a hollow barrel with an open end and a closed end and two ink tubes in the barrel having one end secured to the closed end and having the other ends of the ink tubes extending through the open end, a ball extending out of the end of each ink tube, the ink tubes being free to twist upon each other in the said open end, thereby providing an interesting pattern in writing.

6 Claims, 5 Drawing Figures

PEN FOR WRITING A DOUBLE LINE

OBJECTS OF THE INVENTION

It is an object of the invention to provide an improved pen.

Another object of the invention is to provide an improved writing instrument.

Another object of the invention is to provide a writing instrument that is simple in construction, economical to manufacture, and simple and interesting to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWING

DETAILED DESCRIPTION OF THE DRAWING

Figure 1:
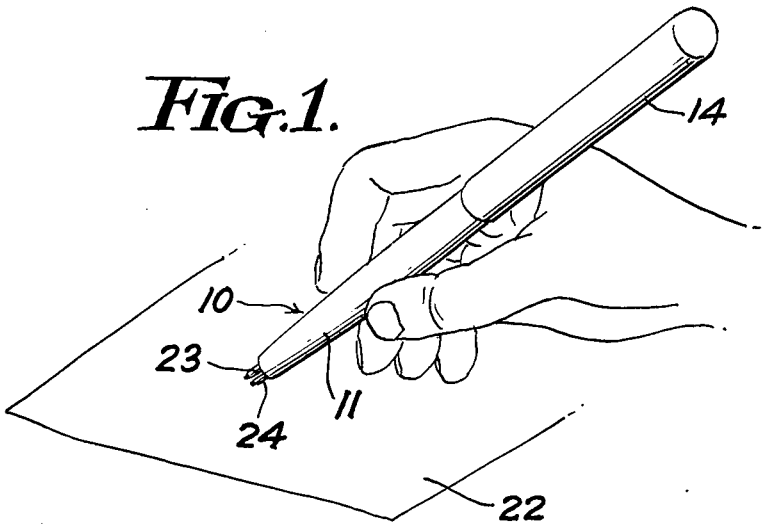
FIG. 1 is an isometric view of the writing instrument shown in writing position.
Figure 2:
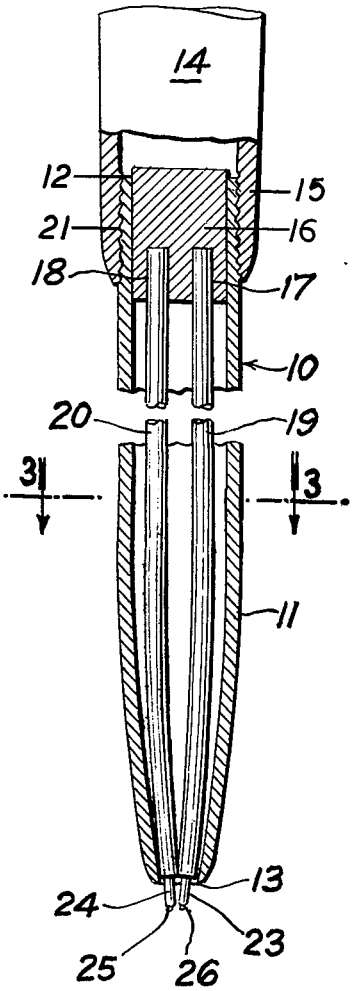
FIG. 2 is a vertical cross sectional view of the writing instrument according to the invention.

Now, with more particular reference to the drawing, the pen indicated generally at 10 in its preferred embodiment is of the type generally referred to as a ball point pen but it has two writing ends 23 and 24.

The pen 10 has a hollow barrel 11 which has a closed end 12 having a plug 16 and an open end 13 through which the writing ends 23 and 24 extend. The pen 10 may have a cap 14 with a threaded member 15 that threadably engages thread 21 on the cap end.

The closed end 12 of the hollow barrel 11 has a plug 16 which has holes 17 and 18. Holes 17 and 18 receive flexible members 19 and 20. Flexible members 19 and 20 may be ink-receiving tubes which terminate at writing ends 23 and 24. Writing ends 23 and 24 may have balls 25 and 26 which engage the paper writing surface 22 and apply ink in a conventional manner. The plug 16 may have movable means whereby the writing ends 23 and 24 may be retracted inside the hollow barrel 11 in a conventional manner.

Figure 3:
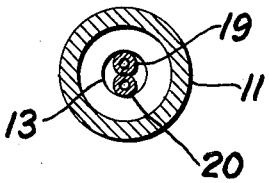
FIG. 3 is a cross sectional view of the writing instrument taken on line 3—3 of FIG. 2.
Figure 4:
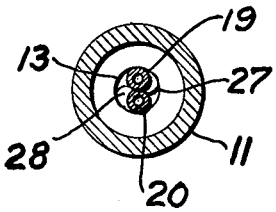
FIG. 4 is a cross sectional view of the writing instrument taken on line 3—3 of FIG. 2 shown with the writing ends in movable position according to the invention.
Figure 5:
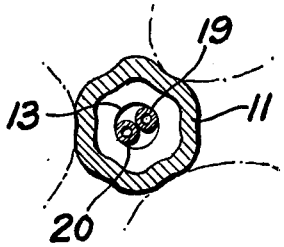
FIG. 5 is another embodiment of the invention shown in cross section and taken on line 3—3 of FIG. 2.

Flexible members 19 and 20 permit ends 23 and 24 to rotate on each other and to twist around each other, as shown in FIG. 4 at 27 and 28, so that, when the user writes, for example when drawing a circle, the writing ends 23 and 24 will draw lines that cross and recross each other. In writing a name, for example, double lines are described which cross and recross each other as the person writes. FIGS. 3 and 4 illustrate the rotation or twisting action of the flexible members 19 and 20 which provides the double writing effect. FIG. 5 illustrates another embodiment of the invention wherein the hollow tube 11 has a hexagonal concave surface which provides for better grip and manipulation of the double pen according to the invention.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A writing instrument comprising a hollow body open at one end with two elongated flexible members inside said body and rigidly secured thereto at their ends remote from said open end and extending substantially to said open end, in engagement with each other and in engagement with said body around said open end, writing means on the outer ends of said flexible members, extending from said open end, said flexible members being free to slide and twist on each other and slide on said body at said open end, whereby said writing ends engage a writing surface and describe two lines that cross each other irrespective of the position in which said body is held by the hand of the writer.

2. The writing instrument recited in claim 1 wherein said flexible members comprise tubular ink-containing members and said writing means comprising ball means on said flexible members.

3. The writing instrument recited in claim 1 wherein said means supporting said ends of said tubular members comprises a cap engaging said hollow body, two radially-spaced, axially extending bores in said cap receiving said ends of said tubular members.

4. The writing instrument recited in claim 3 wherein said closed end of said body has an external thread and said cap has an internally-threaded portion threadably engaging said external portion of said body.

5. The writing instrument recited in claim 1 wherein said writing instrument has means thereon to secure said writing instrument to an item of clothing.

6. The writing instrument recited in claim 1 wherein said said hollow body is hexagonal in cross section.

* * * * *